United States Patent [19]

Nakamura et al.

[11] Patent Number: 4,498,431

[45] Date of Patent: Feb. 12, 1985

[54] VARIABLE VALVE-TIMING APPARATUS IN AN INTERNAL-COMBUSTION ENGINE

[75] Inventors: Norihiko Nakamura, Mishima; Toyokazu Baika, Susono, both of Japan

[73] Assignee: Toyota Jidosha Kabushiki Kaisha, Toyota, Japan

[21] Appl. No.: 443,919

[22] Filed: Nov. 23, 1982

[30] Foreign Application Priority Data

Feb. 8, 1982 [JP] Japan ..... 57-17595

[51] Int. Cl.[3] ..... F01L 1/34

[52] U.S. Cl. ..... 123/90.15; 123/90.17

[58] Field of Search ..... 123/90.15, 90.17; 64/1, 64/120

[56] References Cited

U.S. PATENT DOCUMENTS

| | | | |
|---|---|---|---|
| 1,632,223 | 6/1927 | Fey | 123/90.17 |
| 2,682,260 | 6/1954 | Lantz | 123/90.17 |
| 3,626,720 | 12/1971 | Meacham et al. | 64/25 |
| 3,685,499 | 8/1972 | Meacham et al. | 123/90.15 |
| 3,978,829 | 9/1976 | Takahashi et al. | 123/90.15 |
| 4,279,131 | 7/1981 | Pringle | 64/21 |

*Primary Examiner*—Michael Koczo
*Assistant Examiner*—Peggy A. Neils
*Attorney, Agent, or Firm*—Kenyon & Kenyon

[57] ABSTRACT

An apparatus for controlling valve timing in an internal-combustion engine. The apparatus includes a pair of coaxial sleeves, one inserted into the other. One of the sleeves is connected to a camshaft of the engine, and the other sleeve is connected to a timing pulley which is connected to the crankshaft of the engine. One of the sleeves has diametrically opposite slits while the other sleeve has diametrically opposite slits located adjacent to the respective slits in the one sleeve. The adjacent slits are skewed with respect to each other. Roller-bearing units are arranged in the slits and are mounted on an axially slidable slider. The slider is connected via a screw mechanism to a rotary motor. The rotational movement of the motor is changed to a linear movement of the slider, thereby causing the slider to move, which movement, in turn, causes the generation of angular displacement between the sleeves so as to obtain a variable valve timing.

9 Claims, 8 Drawing Figures

Fig. 2-bis

VARIABLE VALVE-TIMING APPARATUS IN AN INTERNAL-COMBUSTION ENGINE

DESCRIPTION OF THE INVENTION

The present invention relates to an apparatus for attaining variable control of valve timing in an internal-combustion engine.

Variable control is used to obtain valve timings which are adapted to various engine operating conditions, such as low-speed and high-speed operation. Many types of such apparatuses have heretofore been proposed. The most typical type of such apparatus includes a mechanism by which the angular relationship between a crankshaft and a camshaft connected thereto is changed. The mechanism conventionally includes differential gears or planetary gears.

A certain degree of backlash inevitably occurs due to the fact that a torque is generated in one direction when the valves are open, this direction being opposite to the direction in which a torque is generated when the valves are closed. This generated backlash causes operational noise to increase and transmission efficiency to decrease.

Thus, an object of the present invention is to provide a variable valve-timing control apparatus with no gear mechanism.

The present invention is now described with reference to the attached drawings, in which.

Figure 2:
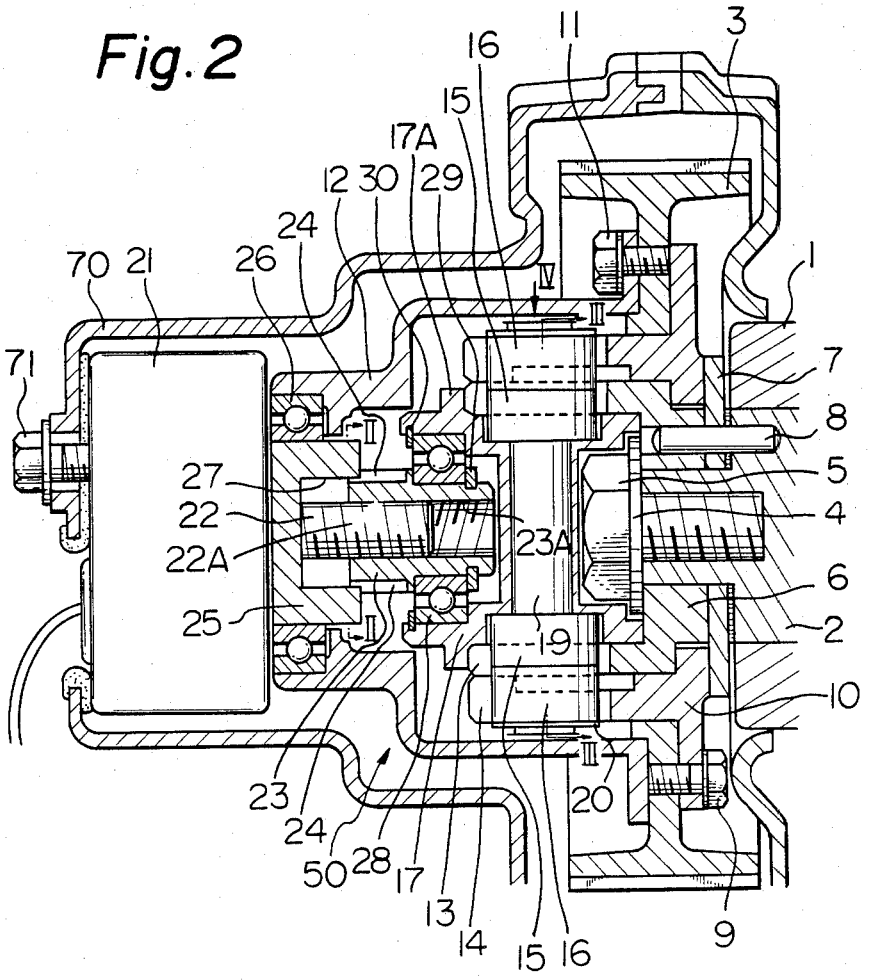
FIG. 2 is a longitudinal cross-sectional view of the apparatus of the present invention.
Figure 2:
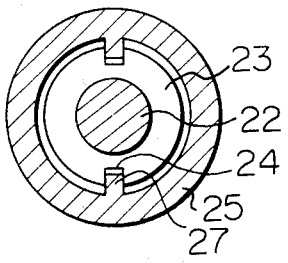

FIG. 2-bis is a transverse cross-sectional view taken along the line II—II in FIG. 2.

Figure 3:
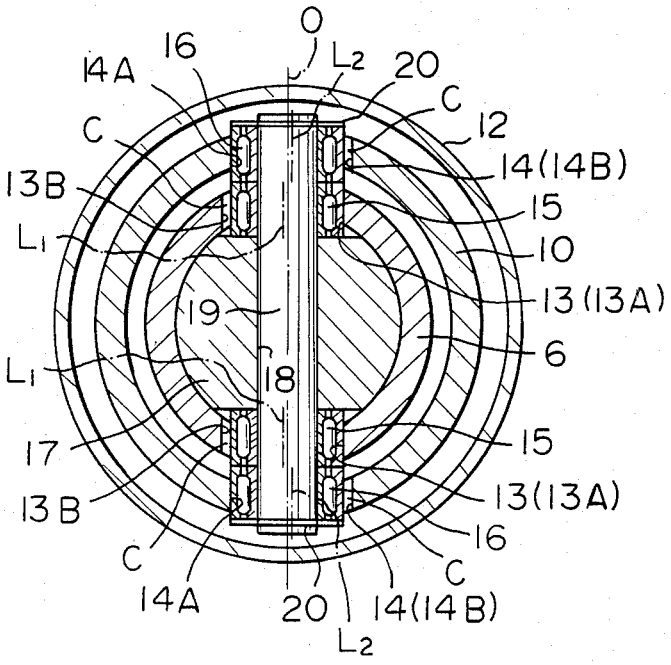
Figure 4:
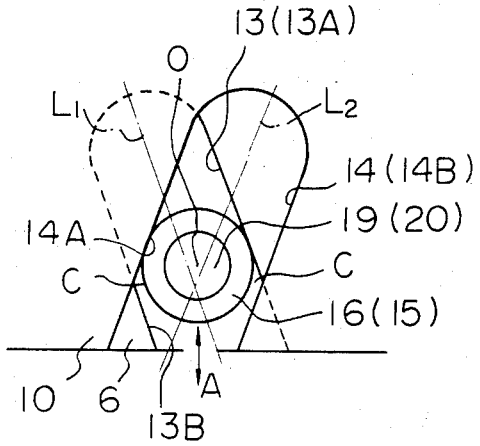
Figure 5:
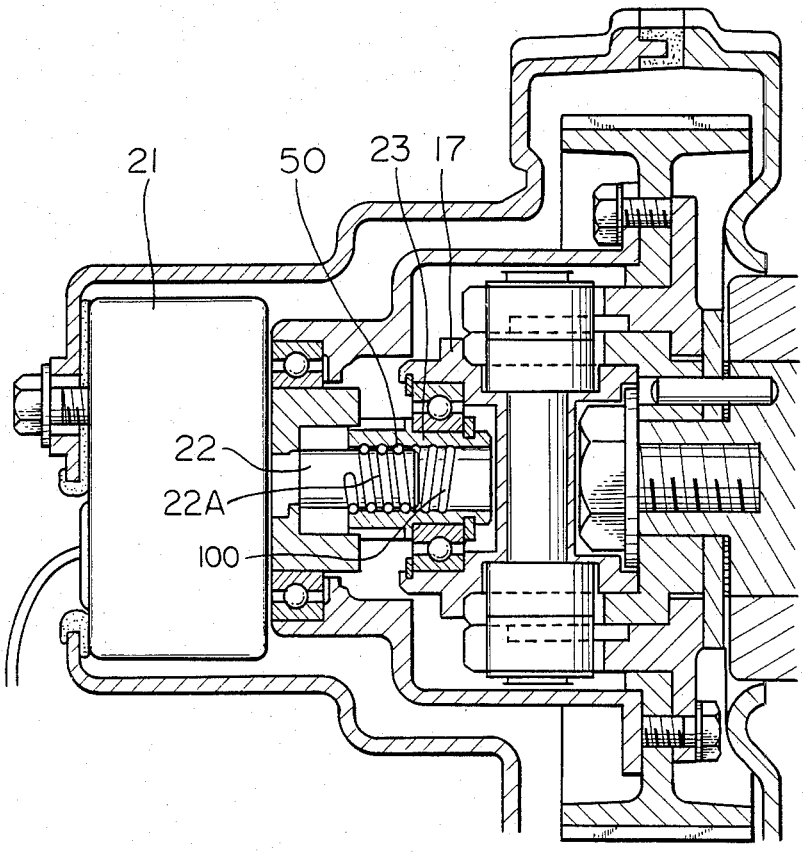
Figure 6:
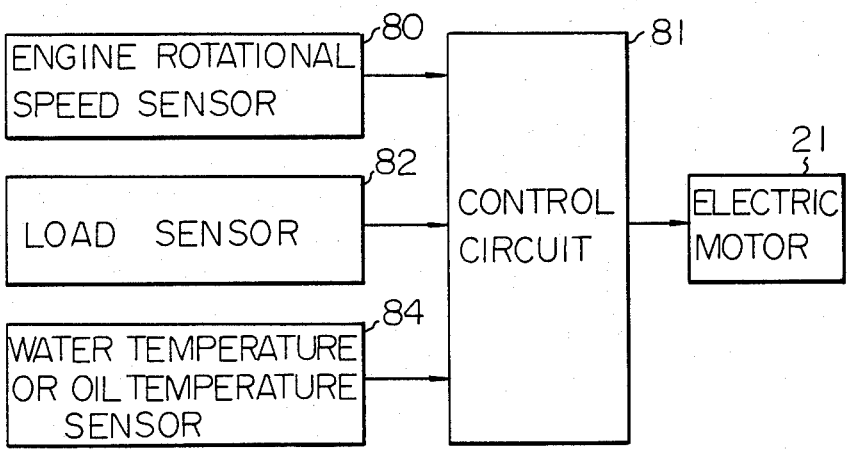

FIG. 3 is a cross-sectional view taken along the line III—III in FIG. 2;

FIG. 4 shows a plan view seen along the line IV—IV in FIG. 2;

FIG. 5 is a longitudinal cross-sectional view, similar to FIG. 2, of a second embodiment of the present invention;

FIG. 6 is a block diagram of the control system; and

Figure 7:
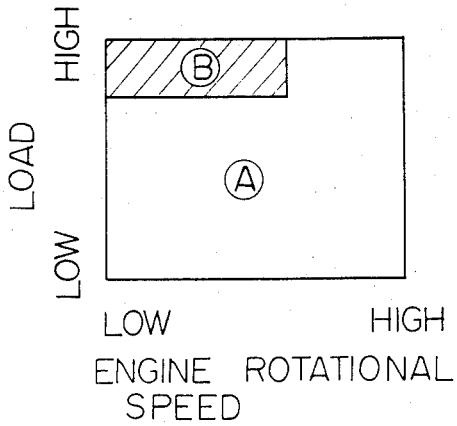

FIG. 7 is an example of the pattern of change of valve timings, in accordance with combinations of engine speed and engine load.

Figure 1:
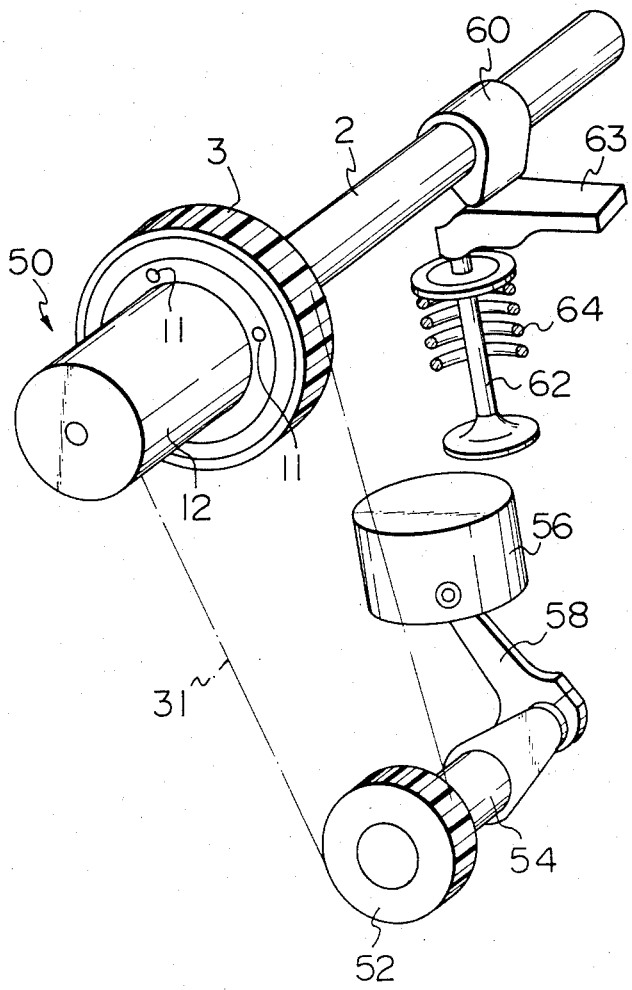
FIG. 1 is a perspective view indicating the connection of a crankshaft to a camshaft in an internal-combustion engine.

In FIG. 1, reference numeral 2 denotes a camshaft. The camshaft 2 is rotatably supported on a cylinder head 1 (FIG. 2). To one end of the camshaft 2, a timing pulley 3 is connected via an apparatus for controlling the angular relationship between two rotating bodies of the present invention, this apparatus being generally shown by reference numeral 50. The timing pulley 3 is connected, by way of a timing belt 31, to a timing pulley 52 on a crankshaft 54. A piston 56 is connected to the crankshaft 54 by a connecting rod 58. A cam 60 is integrally formed on the camshaft 2. The cam 60 can cooperate with an intake or exhaust valve 62. A rocker arm 63 is arranged between the cam 60 and the valve 62. A spring 64 pushes the valve stem toward the cam 60 so that the valve is normally in the closed position.

The apparatus 50 is adapted for controlling the relative angular relationship between the camshaft 2 and the timing pulley 3 of the internal-combustion engine so as to control the timing of the valve 62. The apparatus includes, as shown in FIG. 2, an inner sleeve 6 mounted onto the camshaft 2 after a washer 7. The inner sleeve 6 is fixedly connected to the camshaft 2 by a washer 4 and a bolt 5. A lock pin 8 is inserted through the inner sleeve 6, the washer 7, and the camshaft 2 so that no relative rotation takes place between these parts.

An outer sleeve 10 is fixedly connected to the timing pulley 3 by a bolt 9. A case 12 is also connected to the timing pulley 3 by a bolt 11. The outer sleeve 10 is rotatably mounted on the inner sleeve 6.

The inner sleeve 6 has a pair of diametrically spaced slits 13, and the outer sleeve 10 has a pair of diametrically spaced slits 14 located adjacent to the corresponding slits 13 in the inner sleeve 6. The adjacent slits 13 and 14 are skewed with respect to each other, as shown in FIG. 4. The slits 13 have facing inner edges 13A and 13B extending parallel to a the central axis $L_1$, and the slits 14 have facing inner edges 14A and 14B extending parallel to a central axis $L_2$. Rollers 15 and 16, as abutment members, are located in the slits 13 and 14, respectively. The rollers 15 and 16 have a common axis O of rotation from which the central axes $L_1$ and $L_2$ in the adjacent slits 13 and 14 are oppositely spaced. Thus, the adjacent rollers 15 and 16 contact the inner edges 13A and 14A, respectively, which face each other, and the adjacent rollers 15 and 16 are spaced from the inner edges 13B and 14B, respectively, so that clearances C are provided between the rollers 15 and 16 and the corresponding inner edges 13B and 14B, respectively. Due to this single contact arrangement of the rollers 15 and 16, backlash between the sleeve members 6 and 10 is mitigated when the rollers 15 and 16 move along the slits 13 and 14, respectively.

As shown in FIG. 3, the central axis $L_1$ of the diametrically opposite slits 13 is located on one side of the axis O of the rollers while the central axis $L_2$ of the diametrically opposite slits 14 is located on the opposite side of the axis O. Due to this arrangement, no backlash takes place even if the camshaft is loaded in either direction.

The rollers 15 and 16 are mounted on a common shaft 19 passing through a bore 18 formed in a slider 17. Clips 20 prevent the rollers 15 and 16 from falling off the shaft 19.

As shown in FIGS. 2 and 3, the slider 17 is axially slidably inserted into the inner sleeve 6. The slider 17 has an annular projection 17A which contacts the inner sleeve 6 to stop movement of the slider 17 toward the camshaft 2 and which contacts the case 12 to stop movement of the slider 17 away from the camshaft 2. Thus, the slider can move axially within a limited range.

According to the present invention, a drive mechanism is provided for generating such axial movement of the slider 17. Reference numeral 21 denotes a rotary motor such as an electric motor or hydraulic motor. The motor 21 is mounted on a timing pulley cover 70 by means of a bolt 71. The motor 21 has an output shaft 22 on which an outer screw thread 22A is formed. Reference numeral 23 denotes a sleeve nut having an inner screw thread 23A engaging with the outer screw thread 22A of the shaft 22. The sleeve nut 23 has a pair of diametrically spaced guide grooves 24 which extend axially. A guide ring 25 fixedly connected to the motor housing has a pair of diametrically spaced guide projections 27 inserted into the guide grooves 24 in the sleeve nut 23 (FIG. 2-bis). Thus, the rotary movement of the shaft 22 is transformed into an axial slide movement of the sleeve nut 23.

On the guide ring 25, a bearing unit 26 for rotatably supporting the case 12 is mounted. On the sleeve nut 23, an inner race of a bearing unit 28 is, connected by a clip 29. The bearing unit 28 has an outer race which is connected to the inner sleeve 6 by a clip 30. The bearing unit 28 is adapted for rotatably supporting the slider 17 on the one hand and for transmitting the linear movement of the sleeve nut 23 to the slider 17 on the other hand.

Now the operation of the apparatus according to the present invention will be described. The rotational movement of the crankshaft 54 is transmitted to the timing pulley 3 via the timing belt 31. Thus, the outer sleeve 10 rotates together with the timing pulley 3 so that a force is applied to the rollers 16 to rotate the rollers about the axis of the camshaft 2. As a result, the slider 17, together with the common shaft 19, rotates. The rotational movement of the common shaft 19 causes the slits 13 of the inner sleeve 6 to engage with the rollers 15 therein, thereby causing the camshaft 2 to rotate. Thus, the crankshaft 54 is connected to the camshaft 2 in rotation. In other words, the timing pulley 3 and the camshaft 2 rotate integrally with each other so that the predetermined angular relationship between the crankshaft 54 and the camshaft 2 is maintained. Thus, the valve 62 cooperating with the cam 60 on the camshaft 2 operates within a predetermined angle range of the crankshaft 54 to open or to close the valve 62. Thus, the predetermined valve timing is obtained.

When it is necessary to change the valve timing due to a change in the operating condition of the engine, the motor is, by a control system hereinafter described, operated to cause the output shaft 22 to rotate. The rotational movement of the shaft 22 is changed into an axial movement of the sleeve nut 23 due to the screw engagement between the parts 22 and 23. Thus, the slider 17 connected to the sleeve nut 23 moves along the axis of the camshaft in FIG. 2 in accordance with the direction of rotation of the shaft 22 of the motor 21. Thus, the shaft 19 provided with the rollers 15 and 16 in the slits 13 and 14, respectively, moves as shown by the arrow A in FIG. 4. Due to the arrangement of the slits 13 and 14, which are skewed with respect to each other, the linear movement of the rollers 15 and 16 is changed into a relative angular movement between the inner sleeve 6 and the outer sleeve 10. Thus, the relative angular position between the crankshaft 54 and the camshaft 2 is changed. This means that the valve timing is varied. It should be noted that the degree of angular displacement is a function of the rotational angle of the motor. The rotational angle of the motor 21 is determined so that a predetermined valve timing change is obtained.

FIG. 5 shows another embodiment of the mechanism for changing the rotational movement of the motor 21 into linear movement of the slider 17. The mechanism is similar to that in FIG. 2 in that it includes a screw and nut mechanism. However, it is different from that in FIG. 2 in that it is formed as a so-called recirculating ball-screw type of mechanism. The screw thread 22A on the output shaft 22 is connected to an endless screw thread 100 in the sleeve nut 23 via balls 50 arranged therebetween. The detailed construction of the thread 100 is not shown since it is itself well known. Due to the employment of such a recirculating ball-screw mechanism, the frictional loss at the screw mechanism is decreased and the power necessary to change the valve timing is decreased.

FIG. 6 schematically illustrates a control circuit for operating the rotary motor 21 to obtain a predetermined valve timing in accordance with the operation condition of the engine. The control circuit 81 is a programmed computer which receives signals from sensors, such as an engine rotational speed sensor 80, an engine road sensor 82, and an engine cool-water temperature or lubricant-oil temperature sensor 84. The control circuit 81 sends signals directly to the rotary motor 21 to operate it.

In FIG. 7, an example of the pattern of change of valve timing is illustrated. When the speed and load sensed by the sensors 80 and 82 are in the range B, the control circuit 81 does not operate, with the result that the slider 17 is in a position near the inner sleeve 6. When the speed and load are in the range A, the control circuit 81 operates so that the slider 17 is in a position remote from the camshaft.

Many modifications and changes may be made by those skilled in the art without departing from the scope of the present invention.

We claim:

1. An apparatus for controlling the relative angular relationship between two interconnected rotating bodies so that said bodies have a common first axis of rotation, said apparatus comprising:

a first sleeve member which is fixedly connected to one of the bodies;

a second sleeve member which is fixedly connected to the other body, one of said first and second members being rotatably inserted into the other, said first member and second member having two sets of elongated first and second slits, one set of said slits being circumferentially spaced from the other set, the first slit of each set being located in the first sleeve member, the second slit of each set being located in the second sleeve member adjacent to said first slit of the same set in the first member, the adjacent first and second slits of each set being skewed with respect to each other and at least one of the slits of each set being skewed with respect to said axis;

abutment means arranged in said adjacent slits of each set for causing a relative angular displacement between the first and the second sleeve members in response to movement of the abutment means along the first axis, said abutment means comprising two corresponding sets of first and second rollers which are arranged in said first and second slits, respectively, of each set of slits so that the rollers are in contact with the corresponding slits, and means for allowing free and independent rotation of each of the rollers about a respective second axis transverse to the first axis, the two first slits being arranged so that they contact the corresponding first rollers on only one side of said second axis, and the two second slits being arranged so that they contact the corresponding second rollers on only the other side of said second axis, thereby eliminating backlash between the inner and outer sleeves;

a slider on which said abutment means are mounted, said slider being movable along said first axis while rotatable about the first axis; and drive means for moving the slider along the first axis, said drive means comprising a rotary motor and means arranged between the rotary motor and the slider for changing rotation of the rotary motor into linear movement of the slider, thereby causing relative angular displacement between the rotating bodies in accordance with the rotation of the motor.

2. An apparatus according to claim 1, wherein said means for changing rotation of the rotary motor to linear movement of the slider comprises a nut which is movable along the first axis and which is rotatably connected to the slider, and a screw means for attaining a screw engagement of the rotary motor with the nut.

3. An apparatus according to claim 2, wherein said screw means comprise a first screw thread on the motor and a second screw thread on the nut, wherein said second screw thread on the nut engages with the first screw thread on the motor.

4. An apparatus according to claim 2, wherein said screw means comprise a first screw thread on the motor and a second screw thread on the nut, one of which threads is endless, and balls arranged to engage both of said screw threads.

5. An apparatus according to claim 1, wherein the two sets of slits are arranged in approximately diametrically opposed relationship.

6. A system for connecting, in an internal-combustion engine, a crankshaft to a camshaft, said apparatus comprising a driven member having a first axis of rotation common to that of the camshaft;

a power-transmitting member for connecting the crankshaft to the driven member;

a first sleeve member fixedly connected to the camshaft;

a second sleeve member fixedly connected to the driven member, said first and second sleeves being coaxial with the first axis;

one of said first and second sleeve members being rotatably inserted into the other; said first sleeve member and second sleeve member having two sets of elongated first and second slits, one set of said slits being circumferentially spaced from the other set, the first slit of each set being located in the first sleeve member, the second slit of each set being located in the second sleeve member adjacent to the corresponding first slit in the first member, the adjacent slits in each set being skewed with respect to said first axis;

abutment means arranged in said adjacent slits of each set for causing a relative angular displacement between the first and the second sleeve members in response to movement of the abutment means along the first axis, said abutment means comprising two corresponding sets of first and second rollers which are arranged in said first and second slits, respectively, of each of set of slits so that the rollers contact corresponding slits, and means for allowing free and independent rotation of each of the rollers about a second axis transverse to the first axis, the two first slits being arranged so that they contact the corresponding first rollers on only one side of said second axis, and the two second slits being arranged so that they contact the corresponding second rollers on only the other side of said second axis, thereby eliminating backlash between the inner and outer sleeves;

a slider on which said abutment means are mounted, said slider being movable along said first axis while rotatable about the first axis;

drive means for moving the slider along the first axis, said drive means comprising a rotary motor and means arranged between the rotary motor and the slider for changing rotation of the rotary motor into linear movement of the support means; and means responsive to the operating conditions of the engine for operating the drive motor, whereby the relative angular position of the camshaft with respect to the crankshaft is controlled so as to obtain a variable valve timing.

7. A system according to claim 6, wherein said control means comprise sensor means for detecting the operating conditions of the engine and a control circuit for sending signals directly to the rotary motor for operating the motor in accordance with the operating conditions of the engine.

8. A system according to claim 7, wherein said sensor means comprise a first sensor for detecting the speed of the engine and a second sensor for detecting the load of the engine.

9. A system according to claim 6, wherein the corresponding first slits of the two sets are approximately diametrically opposed, and the corresponding second slits of the two sets are approximately diametrically opposed.

* * * * *